US010996610B2

(12) United States Patent
Kurita et al.

(10) Patent No.: US 10,996,610 B2
(45) Date of Patent: May 4, 2021

(54) SHEET CONVEYING APPARATUS

(71) Applicant: TOSHIBA TEC KABUSHIKI KAISHA, Tokyo (JP)

(72) Inventors: Eizo Kurita, Shizuoka (JP); Akira Nuita, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 325 days.

(21) Appl. No.: 16/231,179

(22) Filed: Dec. 21, 2018

(65) Prior Publication Data

US 2020/0201234 A1 Jun. 25, 2020

(51) Int. Cl.

*G03G 15/00* (2006.01)
*B65H 29/58* (2006.01)
*B65H 5/06* (2006.01)

(52) U.S. Cl.

CPC ..... *G03G 15/6579* (2013.01); *B65H 5/062* (2013.01); *B65H 29/58* (2013.01); *B65H 2301/33312* (2013.01); *B65H 2403/481* (2013.01); *B65H 2403/732* (2013.01); *B65H 2404/166* (2013.01); *G03G 2215/00586* (2013.01)

(58) Field of Classification Search

CPC ..... G03G 15/6579; G03G 2215/00586; B65H 5/062; B65H 29/58; B65H 2301/33312; B65H 2403/481; B65H 2403/732; B65H 2404/166

See application file for complete search history.

(56) References Cited

U.S. PATENT DOCUMENTS 5,974,283 A * 10/1999 Cho ..... B65H 15/00 399/75
8,613,445 B2 * 12/2013 Nishii ..... B65H 9/006 271/291
8,646,776 B2 * 2/2014 Agata ..... B65H 5/062 271/270
2008/0284090 A1 * 11/2008 Honda ..... G03G 15/234 271/225
2010/0192710 A9 * 8/2010 Hanashima ..... B65H 1/14 74/55
2013/0106050 A1 * 5/2013 Nishii ..... B65H 9/006 271/225

(Continued)

FOREIGN PATENT DOCUMENTS

JP 2009-062109 A 3/2009

*Primary Examiner* — David H Banh
(74) *Attorney, Agent, or Firm* — Foley & Lardner LLP

(57) ABSTRACT

A sheet conveying apparatus includes a paper re-feeding path, a switching member, a reversing roller, a paper discharge roller, a motor, and a revolution control mechanism. The switching member can be switched between a first position and a second position. The reversing roller can reverse a revolving direction thereof between a first revolving direction and a second revolving direction. The paper discharge roller revolves in a third revolving direction for conveying the sheet in a third conveying direction. The motor reverses the revolving direction of the reversing roller and switches the position of switching member by reversing the revolving direction thereof. The revolution control mechanism revolves the paper discharge roller in the third revolving direction with the revolution of the motor, regardless of the reversing of the revolving direction of the motor.

15 Claims, 8 Drawing Sheets

(56) References Cited

U.S. PATENT DOCUMENTS

| | | | | |
|---|---|---|---|---|
| 2013/0107294 | A1* | 5/2013 | Ito | G03G 21/20 358/1.9 |
| 2013/0187330 | A1* | 7/2013 | Kuroda | B41J 3/60 271/225 |
| 2014/0320877 | A1* | 10/2014 | Kaneko | G03G 15/6529 358/1.13 |
| 2015/0055160 | A1* | 2/2015 | Ito | H04N 1/00933 358/1.13 |
| 2016/0280485 | A1* | 9/2016 | Kakuta | B65H 5/062 |
| 2016/0334751 | A1* | 11/2016 | Kowase | G03G 15/70 |
| 2018/0170701 | A1* | 6/2018 | Mizuguchi | B65H 29/14 |

* cited by examiner

SHEET CONVEYING APPARATUS

FIELD

At least one embodiment described herein relate generally to sheet conveying apparatuses.

BACKGROUND

In an image forming apparatus, a sheet conveying apparatus, such as an automatic duplexing unit (ADU), is used. Such a sheet conveying apparatus switches back a single-sided printed sheet, reverses the front and back of the sheet, and re-feeds the sheet to a printing unit. A sheet conveying apparatus is demanded to reduce a sheet conveying time.

DETAILED DESCRIPTION

At least one exemplary embodiment provides a sheet conveying apparatus including a paper re-feeding path, a switching member (switch), a reversing roller, a paper discharge roller, a motor, and a revolution control mechanism. The paper re-feeding path reverses the front and back of a sheet conveyed from the printing unit (printer) and switched back at the switch-back position and re-feeds the sheet to the printing unit. The switching member can switch between a first position and a second position. The first position is a position for guiding the sheet in a first conveying direction from printing unit toward the switch-back position. The second position is a position for guiding the sheet in a second conveying direction from the switch-back position toward the paper re-feeding path and guiding the sheet in a third conveying direction from the printing unit toward an output tray. The reversing roller can reverse a revolving direction of the reversing roller between a first revolving direction and a second revolving direction. The first revolving direction is a revolving direction for conveying the sheet in the first conveying direction. The second revolving direction is a revolving direction for conveying the sheet in the second conveying direction. The paper discharge roller revolves in a third revolving direction for conveying the sheet in a third conveying direction. The motor which reverses the revolving direction of the reversing roller and switches the position of switching member by reversing the revolving direction thereof. The revolution control mechanism (revolution controller) revolves the paper discharge roller in the third revolving direction with the revolution of the motor, regardless of the reversing of the revolving direction of the motor.

Hereinafter, a sheet conveying apparatus according to at least one embodiment will be described with reference to the drawings.

Figure 1:
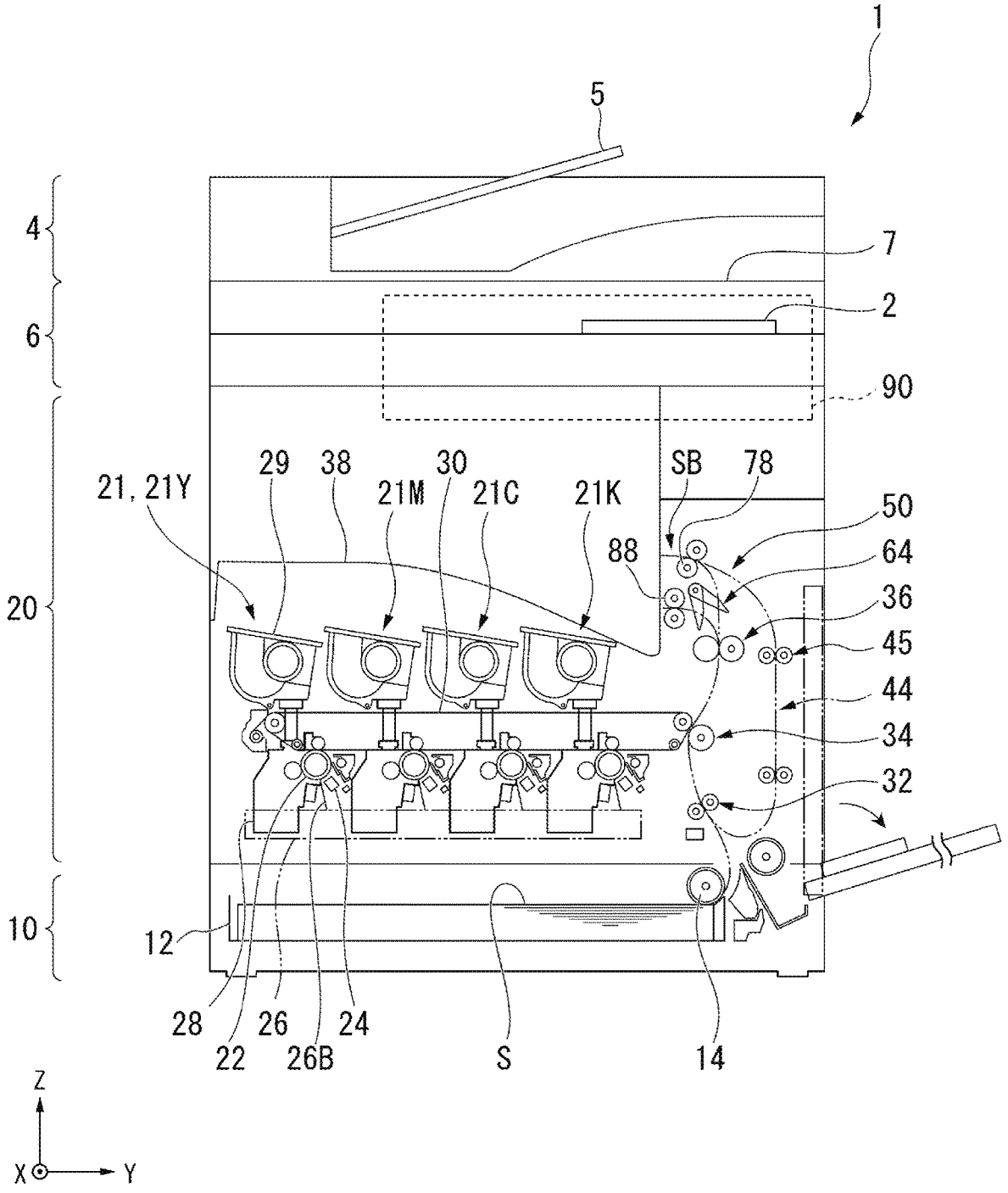
FIG. 1 is a schematic configuration view of an image forming apparatus according to some embodiments.

FIG. 1 is a schematic view of an image forming apparatus.

In the present specification, an X direction, a Y direction and a Z direction are defined as follows. The X direction is the front-back direction of an image forming apparatus 1. A +X direction is the forward direction as seen from an operator of the image forming apparatus 1 (facing a paper surface in FIG. 1). The Y direction is the left-right direction of the image forming apparatus 1. A +Y direction is the rightward direction as seen from the operator of the image forming apparatus 1 (facing the paper surface in FIG. 1). The Z direction is the vertical direction, and a +Z direction is the upward direction.

As shown in FIG. 1, the image forming apparatus 1 includes an operation panel 2, an automatic document feeder (ADF) 4, a scanner 6, a sheet feeder 10, a printing unit 20, a sheet conveying apparatus 50, and a control unit 90 (controller).

The operation panel 2 is a part of an input unit through which an operator inputs information for operating the image forming apparatus 1. The operation panel 2 includes a touch panel and/or various hard keys.

The ADF 4 conveys a document placed on a document loading unit 5 to a document holder 7 of the scanner 6.

The scanner 6 reads image information of the document placed on the document holder 7 as light and shade. The scanner 6 outputs the read image information to the printing unit 20.

The sheet feeder 10 feeds sheets S one by one to the printing unit 20 at timings where the printing unit 20 forms toner images. The sheet feeder 10 includes a paper feed cassette 12 and a pickup roller 14.

The paper feed cassette 12 accommodates the sheets S of predetermined size and type.

The pickup roller 14 picks up the sheets S one by one from the paper feed cassette 12. The pickup roller 14 feeds the picked-up sheets S to the printing unit 20.

The printing unit 20 forms an output image (hereinafter referred to as a toner image) with a developing agent containing a toner or the like based on the image information read by the scanner 6 or image signals from an external apparatus. The printing unit 20 transfers the toner image onto a surface of the sheet S. The printing unit 20 applies heat and pressure to the toner image on the surface of the sheet S, thereby fixing the toner image onto the sheet S.

The printing unit 20 includes a resist roller 32, a plurality of image forming units 21, a laser scanning unit 26, an intermediate transfer belt 30, a transfer unit 34, and a fixing unit 36.

The resist roller 32 aligns the leading edge of the sheet S fed from the sheet feeder 10 to a nip. The resist roller 32 conveys the sheet S in accordance with a timing where the printing unit 20 transfers the toner image onto the sheet S.

The image forming unit 21 forms a toner image on a photoconductive drum 22 according to image signals from the scanner 6 or the external apparatus. A plurality of image forming units 21Y, 21M, 21C, and 21K form toner images with toners of yellow, magenta, cyan, and black, respectively.

In addition to the photoconductive drum 22, the image forming unit 21 includes a charging unit 24, the laser scanning unit 26, a developing unit 28, and a toner cartridge 29.

The charging unit 24 charges a surface of the photoconductive drum 22.

The laser scanning unit 26 scans the charged photoconductive drum 22 with a laser light 26B to expose the photoconductive drum 22, thereby forming an electrostatic latent image.

The developing unit 28 develops the electrostatic latent image on the photoconductive drum 22. As a result, a toner image is formed on the photoconductive drum 22.

The toner cartridge 29 contains a developing agent containing a toner.

A toner image on the surface of the photoconductive drum 22 is primarily transferred to the intermediate transfer belt 30.

The transfer unit 34 transfers the toner image primarily transferred onto the intermediate transfer belt 30 onto a surface of the sheet S at a secondary transfer position.

The fixing unit 36 applies heat and pressure to the sheet S, thereby fixing the toner image transferred onto the sheet S.

The sheet conveying apparatus 50 includes a reversing roller 78, a paper re-feeding path 44, a paper re-feeding roller 45, a paper discharge roller 88, and a gate 64.

The reversing roller 78 conveys the sheet S passed through the fixing unit 36 to a switch-back position. The reversing roller 78 switches sheet S back at a switch-back position SB and conveys the sheet S to paper re-feeding path 44.

The paper re-feeding path 44 reverses the front and back of the sheet S and re-feeds the sheet S to the resist roller 32. The paper re-feeding roller 45 conveys the sheet S along the paper re-feeding path 44.

The paper discharge roller 88 discharges the sheet S passed through the fixing unit 36 to a discharge tray 38.

The gate 64 switches a direction for conveying the sheet S.

The sheet conveying apparatus 50 will be described below in detail.

Figure 2:
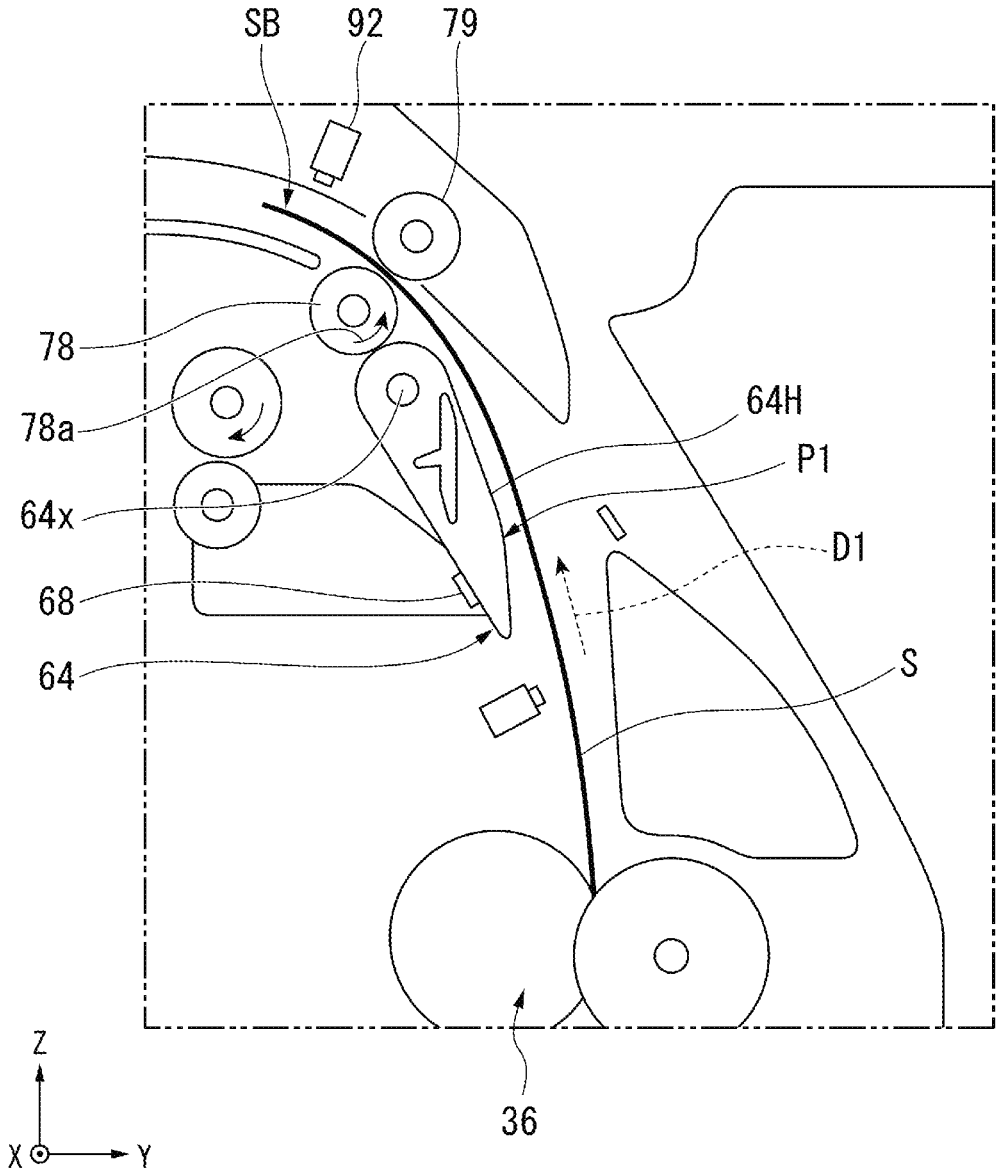
FIG. 2 is a first front sectional view of a sheet conveying apparatus.
Figure 3:
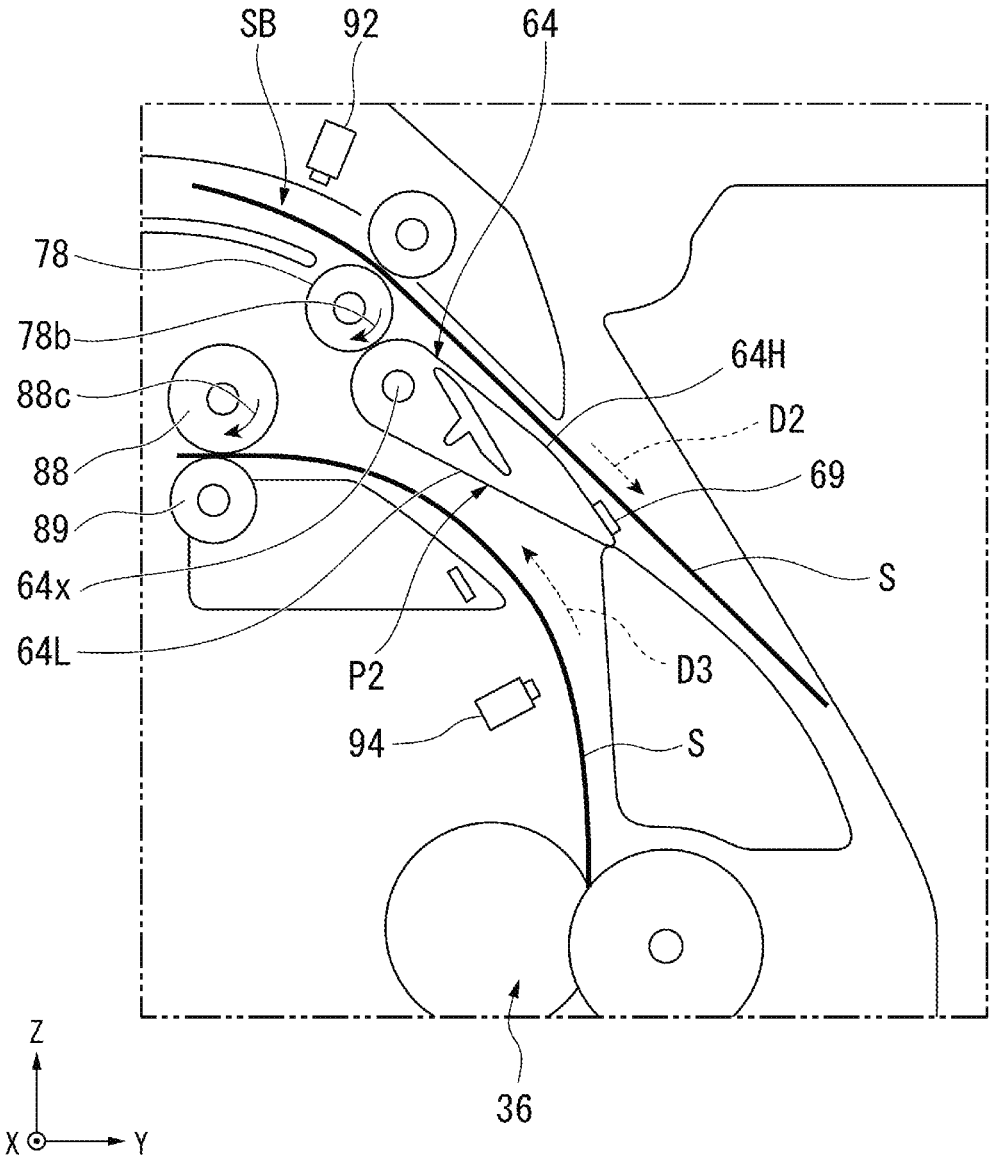
FIG. 3 is a second front sectional view of a sheet conveying apparatus.

FIGS. 2 and 3 are front sectional views of the sheet conveying apparatus 50.

As shown in FIG. 2, the gate (switching member) 64 rotates around a rotation shaft 64*x*. The gate 64 rotates between a first position P1 and a second position P2 (see FIG. 3).

In FIG. 2, the gate 64 is located at the first position P1. The gate 64 located at the first position P1 guides the sheet S in a first conveying direction D1 from the fixing unit 36 toward the switch-back position SB. The switch-back position SB is a position where a direction for conveying a sheet is reversed from the first conveying direction D1 to a second conveying direction D2 (see FIG. 3). The trailing end of the sheet S conveyed in the first conveying direction D1 and arrived at the switch-back position SB passes through the leading end of the gate 64 and is pinched by the reversing roller 78. The gate 64 located at the first position P1 guides the sheet S along an upper edge portion 64H in the first conveying direction D1.

In FIG. 3, gate 64 is located at the second position P2. The gate 64 located in the second position P2 guides the sheet S in the second conveying direction D2 from the switch-back position SB toward the paper re-feeding path 44 (see FIG. 1). The gate 64 located at the second position P2 guides the sheet S along the upper edge portion 64H in the second conveying direction D2.

The gate 64 located at the second position P2 guides the sheet S in a third conveying direction D3 from the fixing unit 36 toward the discharge tray 38. The gate 64 located at the second position P2 guides the sheet S along a lower edge portion 64L in the third conveying direction D3.

As shown in FIG. 2, the reversing roller 78 can reverse a revolving direction between a first revolving direction 78*a* and a second revolving direction 78*b* (see FIG. 3). The first revolving direction 78*a* is a revolving direction for conveying the sheet S in the first conveying direction D1. As shown in FIG. 3, the second revolving direction 78*b* is a revolving direction for conveying the sheet S in second conveying direction D2.

The paper discharge roller 88 revolves in a third revolving direction 88*c* for conveying the sheet S in third conveying direction D3.

Figure 4:
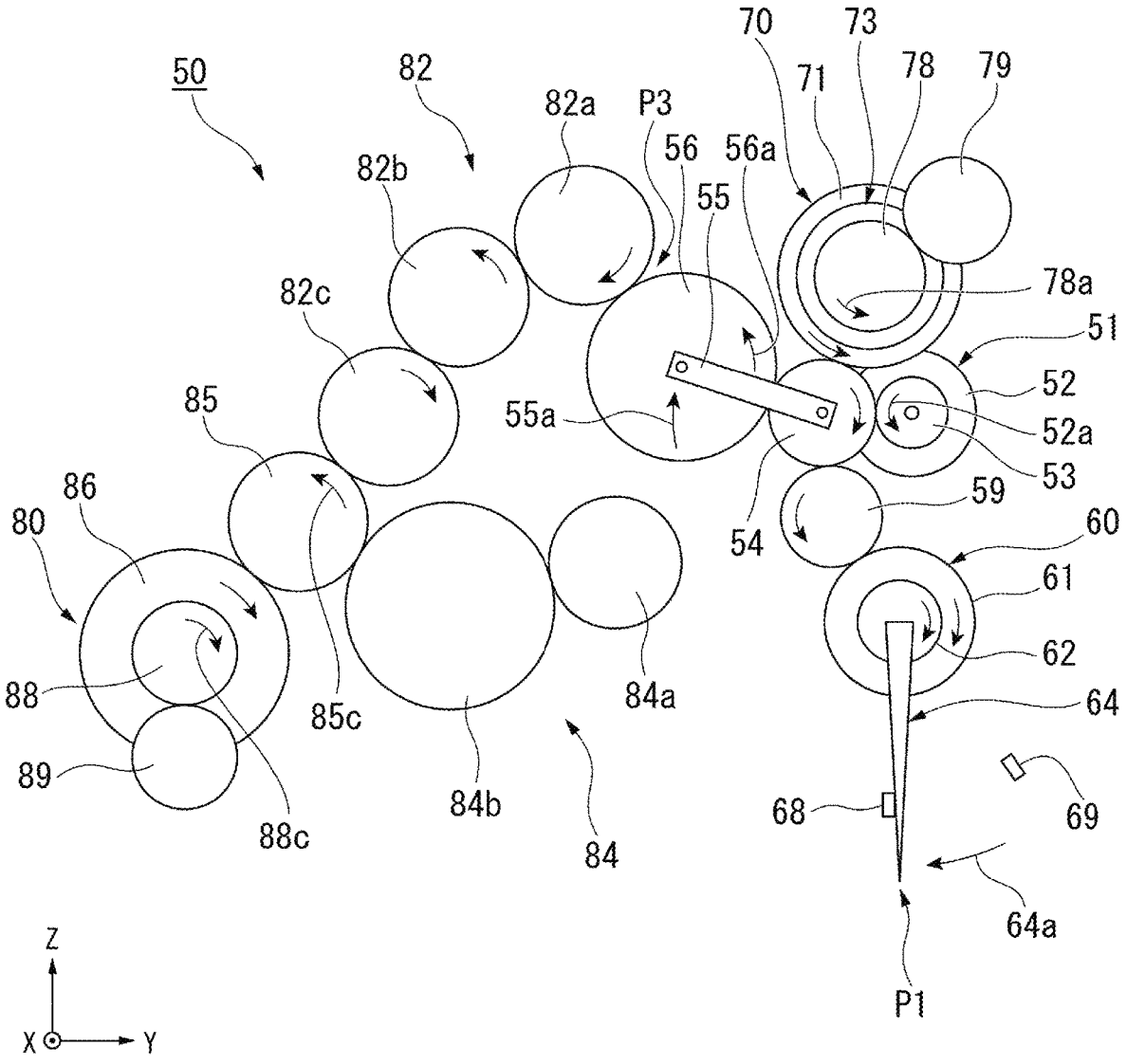
FIG. 4 is a first schematic configuration view of a sheet conveying apparatus.
Figure 5:
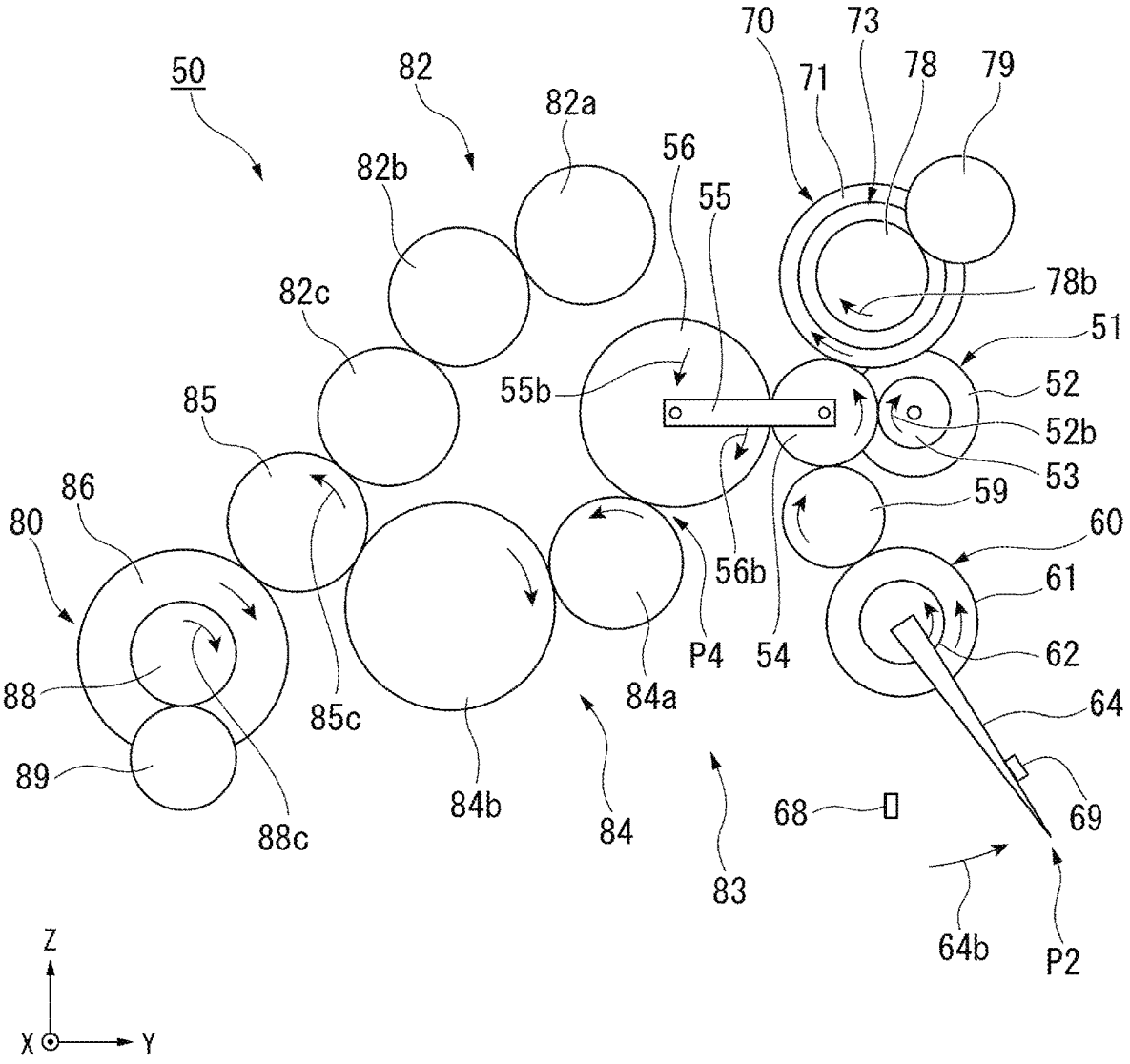
FIG. 5 is a second schematic configuration view of a sheet conveying apparatus.

FIGS. 4 and 5 are schematic view of the sheet conveying apparatus 50. Like FIG. 2, FIG. 4 shows a state in which the gate 64 is located at the first position P1. Like FIG. 3, FIG. 5 shows a state in which the gate 64 is located at the second position P2.

As shown in FIG. 4, the sheet conveying apparatus 50 includes a motor unit 51, a gate unit 60, a reversing roller unit 70, and a paper discharge roller unit 80.

The motor unit 51 includes a motor 52, a motor gear 53, and a sun gear 54.

The motor 52 drives the gate 64, the reversing roller 78, and the paper discharge roller 88. The motor 52 can invert a revolving direction between a first direction 52*a* and a second direction 52*b* (see FIG. 5). The motor 52 switches the position of the gate 64 between the first position P1 and the second position P2 (see FIG. 5) by reversing the revolving direction. The motor 52 reverses the revolving direction of the reversing roller 78 between the first revolving direction 78*a* and the second revolving direction 78*b* (see FIG. 5) by reversing the revolving direction of the motor 52. Even when the motor 52 reverses the revolving direction, the paper discharge roller 88 revolves in the third revolving direction 88*c*.

The motor gear 53 is arranged coaxially with a revolution shaft of the motor 52 and revolves together with the revolution shaft of the motor 52.

The sun gear 54 engages with the motor gear 53 and revolves in conjunction with the motor gear 53.

The gate unit 60 includes an intermediate gear 59, a gate driving gear 61, a torque restricting member 62, the gate 64, a first stopper 68, and a second stopper 69.

The gate driving gear 61 engages with the sun gear 54 via the intermediate gear 59 and revolves in conjunction with the sun gear 54.

Figure 6:
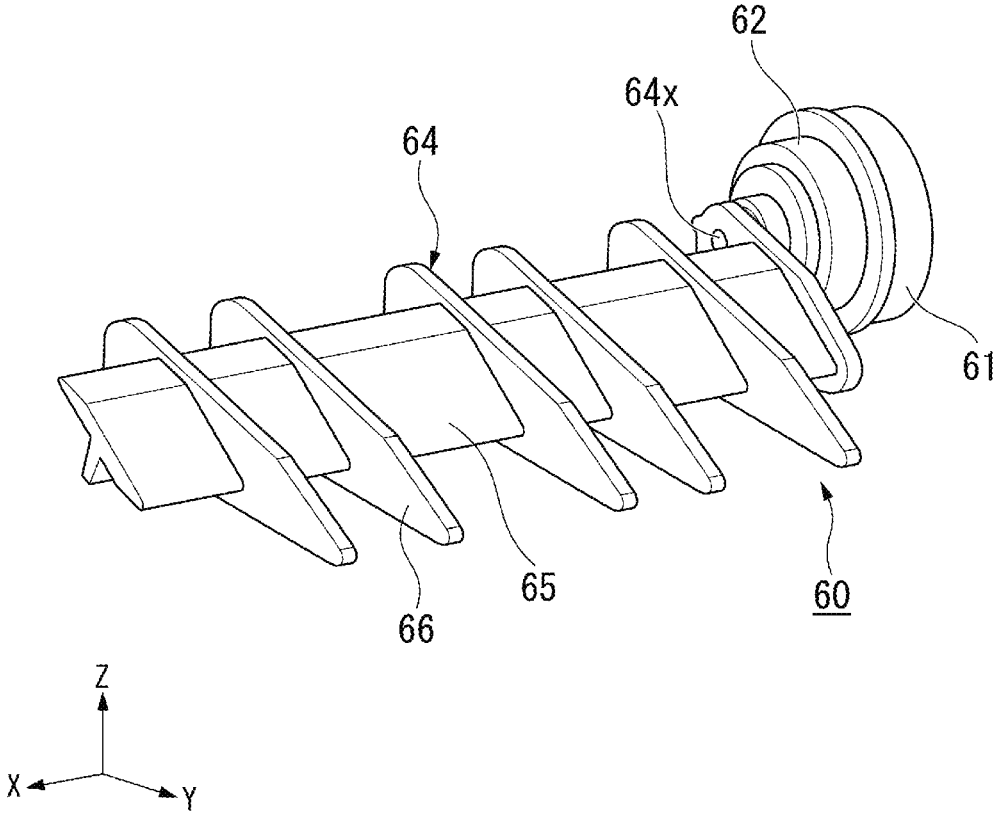
FIG. 6 is a perspective view of a gate unit.

FIG. 6 is a perspective view of the gate unit 60.

The torque restricting member 62 is disposed on a torque transferring path between the gate driving gear 61 and the gate 64. When a torque equal to or below a predetermined value is applied from the gate driving gear 61, the torque restricting member 62 rotates the gate 64 in conjunction with the gate driving gear 61. The torque restricting member 62 applies a torque of a predetermined value to the gate 64 when a torque exceeding the predetermined value is applied from the gate driving gear 61. At this time, the torque restricting member 62 causes a slip between the gate driving gear 61 and the gate 64. The torque restricting member 62 includes a torque limiter, a spring clutch, etc.

As shown in FIG. 4, the first stopper 68 stops the rotation of the gate 64 at the first position P1. When the gate 64 contacts the first stopper 68 and stops rotation, a torque exceeding the predetermined value is generated from the gate driving gear 61 to the torque restricting member 62. The torque restricting member 62 holds the gate 64 at the first position P1 while a torque of the predetermined value is being applied onto the gate 64.

As shown in FIG. 5, the second stopper 69 stops the rotation of gate 64 at the second position P2. The torque restricting member 62 holds the gate 64 at the second position P2 while a torque of a predetermined value is being applied to the gate 64.

As shown in FIG. 6, the gate 64 includes a gate plate 65 and a coupling member 66.

The gate plate 65 is arranged orthogonally to the rotation shaft 64*x* of the gate 64. The gate plate 65 tapers from a base unit where the rotation shaft 64*x* is disposed toward a leading end portion. A plurality of gate plates 65 are arranged in parallel. The coupling member 66 interconnects the plurality of gate plates 65 as a single body.

As shown in FIG. 4, the reversing roller unit 70 includes a reversing roller driving gear 71, a coupling 73, the reversing roller 78, and a pinch roller 79.

The reversing roller driving gear 71 engages with the sun gear 54 and revolves in conjunction with the sun gear 54.

Figure 7:
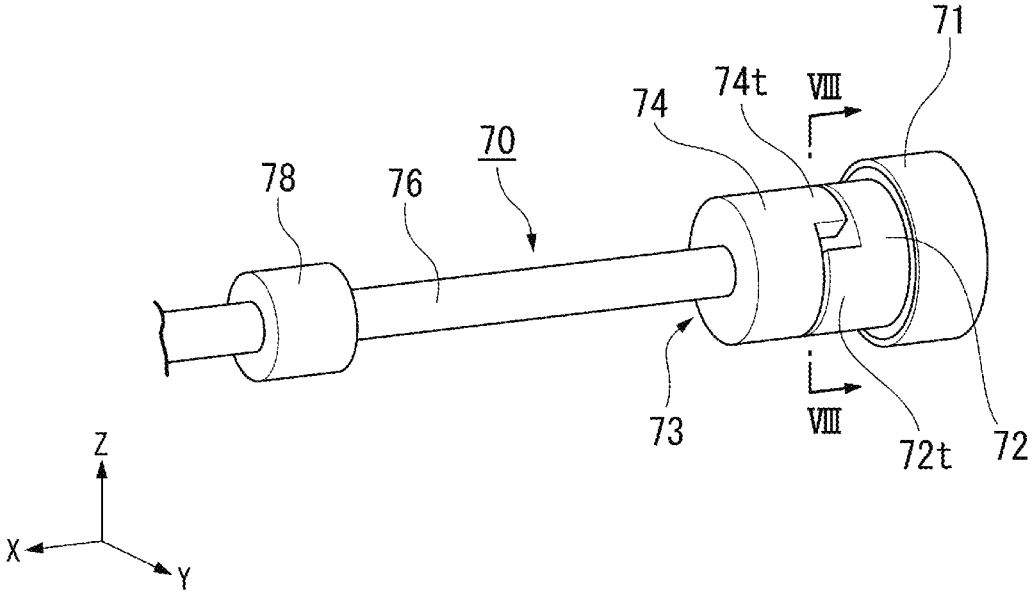
FIG. 7 is a perspective view of a reversing roller unit.

FIG. 7 is a perspective view of the reversing roller unit 70.

The coupling (delaying member) 73 is disposed between the reversing roller driving gear 71 and the reversing roller 78. The coupling 73 includes a driving hand 72 and a driven hand 74. The driving hand 72 is fixed to the +X surface of the reversing roller driving gear 71 coaxially with the reversing roller driving gear 71. The driving hand 72 includes driving teeth 72*t*. The driving teeth 72*t* protrude in the +X direction from the +X surface of the driving hand 72. The driven hand 74 is disposed on the +X side of the driving hand 72 coaxially with the driving hand 72. The driven hand 74 includes driven teeth 74*t*. The driven teeth 74*t* protrude in the −X direction from the −X surface of the driven hand 74.

Figure 8:
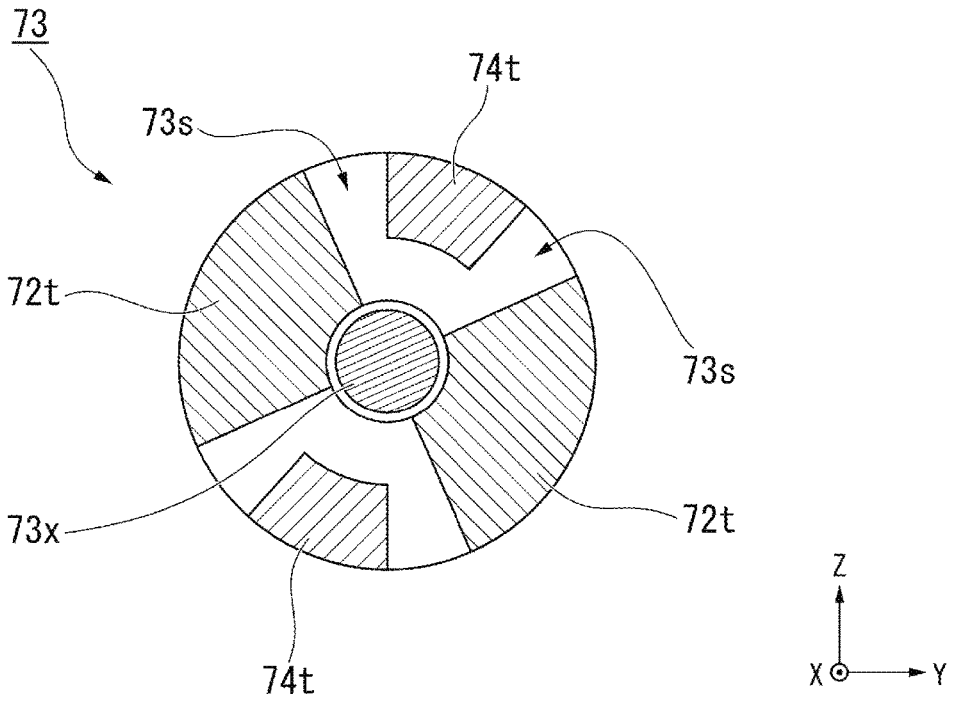
FIG. 8 is a cross-sectional view of a coupling.

FIG. 8 is a cross-sectional view of the center portion of the coupling 73 in the X direction. Driving teeth 72*t* and driven teeth 74*t* are arranged alternately in the circumferential direction of a revolution shaft 73*x*. Between the driving teeth 72*t* and the driven teeth 74*t*, an interval 73*s* is located. Even when the driving hand 72 starts revolving, the driven hand 74 does not revolve while the driving teeth 72*t* move through the interval 73*s*. When the driving teeth 72*t* contact the driven teeth 74*t*, the driven teeth 74*t* are pushed by the driving teeth 72*t* and the driven hand 74 start revolving. Accordingly, the coupling 73 revolves the driven hand 74 later than the driving hand 72.

As shown in FIG. 7, the reversing roller 78 is connected to the driven hand 74 of the coupling 73 via a shaft member 76. The coupling 73 delays the start of reversing of a revolving direction of the reversing roller 78 to be later than the start of reversing of the revolving direction of the motor 52.

As shown in FIG. 4, the pinch roller 79 is arranged side by side with the reversing roller 78. The pinch roller 79 revolves according to the revolution of the reversing roller 78. The pinch roller 79 sandwiches the sheet S between the pinch roller 79 and the reversing roller 78.

As shown in FIG. 4, the paper discharge roller unit 80 includes a revolution control mechanism 83, a paper discharge roller driving gear 86, the paper discharge roller 88, and a pinch roller 89.

The revolution control mechanism 83 includes a planetary gear 56, a carrier 55, a first revolution transferring unit 82, a second revolution transferring unit 84, and a common gear 85.

The planetary gear 56 engages with the sun gear 54. The planetary gear 56 can revolve according to the revolution of the sun gear 54.

The carrier 55 fixes a distance between a revolution shaft of the sun gear 54 and a revolution shaft of the planetary gear 56. The carrier 55 supports the planetary gear 56, such that the planetary gear 56 can move around the sun gear 54. As a result, the planetary gear 56 can revolve around the sun gear 54 as the sun gear 54 revolves.

The first revolution transferring unit 82 includes a first gear 82*a*, a second gear 82*b*, and a third gear 82*c*.

The first gear 82*a* may engage with the planetary gear 56 at a third position P3 on the revolution trajectory of the planetary gear 56. The first gear 82*a*, the second gear 82*b*, and the third gear 82*c* engage with one another in series in the order stated.

The second revolution transferring unit 84 includes a fourth gear 84*a* and a fifth gear 84*b*.

As shown in FIG. 5, the fourth gear 84*a* can engage with the planetary gear 56 at a fourth position P4 on the revolution trajectory of the planetary gear 56. The fifth gear 84*b* engages with the fourth gear 84*a*.

The common gear 85 engages with both the third gear 82*c* of the first revolution transferring unit 82 and the fifth gear 84*b* of the second revolution transferring unit 84.

As shown in FIG. 4, the first revolution transferring unit 82 includes three gears engaged with one another in series, whereas the second revolution transferring unit 84 includes two gears engaged with each other in series. The number of gears of the first revolution transferring unit 82 and the number of gears of the second revolution transferring unit 84 are not limited thereto. The first revolution transferring unit 82 may include an odd number of gears engaged with one another in series, and the second revolution transferring unit 84 may include an even number of gears engaged with each other in series.

The paper discharge roller driving gear 86 engages with common gear 85. Alternatively, the paper discharge roller driving gear 86 may engage with both the third gear 82*c* of the first revolution transferring unit 82 and the fifth gear 84*b* of the second revolution transferring unit 84 without the common gear 85. In this case, the paper discharge roller driving gear 86 functions as the common gear 85. In this case, the first revolution transferring unit 82 may include an even number of gears engaged with each other in series, and the second revolution transferring unit 84 may include an odd number of gears engaged with one another in series.

The paper discharge roller 88 is arranged coaxially with the paper discharge roller driving gear 86. The paper discharge roller 88 revolves together with paper discharge roller driving gear 86.

The pinch roller 89 is arranged side by side with the paper discharge roller 88. The pinch roller 89 is revolved by the revolution of the paper discharge roller 88. The pinch roller 89 sandwiches the sheet S between the pinch roller 89 and the paper discharge roller 88.

The operations of the sheet conveying apparatus 50 shown in FIGS. 4 and 5 will be described.

As shown in FIG. 4, when the motor gear 53 revolves in the first direction 52*a* together with the revolution shaft of the motor 52, the sun gear 54 revolves in the direction indicated by the arrow.

As the sun gear 54 revolves, the intermediate gear 59 and the gate driving gear 61 revolve in the directions respectively indicated by the arrows. As the gate driving gear 61 revolves, the gate 64 rotates in the first direction 64*a*. The gate 64 rotates to the first position P1 and contacts the first stopper 68. By the action of the torque restricting member 62, the gate 64 stops rotation, but the gate driving gear 61 continues revolving. The torque restricting member 62 holds the gate 64 at the first position P1 while the torque of the predetermined value is being applied to the gate 64.

As the sun gear 54 revolves, the reversing roller driving gear 71 revolves in the direction indicated by the arrow. By the action of the coupling 73, the reversing roller 78 starts rotating in the first revolving direction 78*a* later than the start of the revolution of the reversing roller driving gear 71.

As the sun gear 54 revolves, the planetary gear 56 revolves in a third direction 55*a* together with the carrier 55. The planetary gear 56 contacts the first gear 82*a* at the third position P3 and stops revolution. After the revolution is stopped, the planetary gear 56 revolves in the third direction 56*a* according to the revolution of the sun gear 54. As the planetary gear 56 revolves, the gears 82*a*, 82*b*, and 82*c* of the first revolution transferring unit 82 revolve in the directions respectively indicated by the arrows, and the common gear 85 revolves in a fourth revolving direction 85*c*. As the common gear 85 revolves, the paper discharge roller driving gear 81 revolves in the direction indicated by the arrow and the paper discharge roller 88 revolves in the third revolving direction 88*c*.

As shown in FIG. 5, when the motor 52 reverses the revolving direction and the motor gear 53 revolves in the second direction 52*b* together with the revolution shaft of the motor 52, the sun gear 54 revolves in the direction indicated by the arrow.

As sun gear 54 revolves, the gate 64 rotates in a second direction 64*b*. The gate 64 rotates to the second position P2 and contacts the second stopper 69. The torque restricting member 62 holds the gate 64 at the second position P2 while a torque of a predetermined value is being applied to the gate 64.

As the sun gear 54 revolves, the reversing roller driving gear 71 revolves in the direction indicated by the arrow. Due to the action of the coupling 73, the reversing roller 78 starts reversing the revolving direction thereof to the second revolving direction 78*b* later than the start of reversing of the reversing roller driving gear 71.

As the sun gear 54 revolves, the planetary gear 56 revolves in the fourth direction 55*b* together with the carrier 55. The planetary gear 56 contacts the fourth gear 84*a* at the fourth position P4 and stops the revolution. After the revolution is stopped, the planetary gear 56 revolves in the fourth direction 56*b* according to the revolution of the sun gear 54. As the planetary gear 56 revolves, the gears 84*a* and 84*b* of the second revolution transferring unit 84 revolve in the directions respectively indicated by the arrows, and the common gear 85 revolves in the fourth revolving direction 85*c*. As the common gear 85 revolves, the paper discharge roller driving gear 81 revolves in the direction indicated by the arrow and the paper discharge roller 88 revolves in the third revolving direction 88*c*.

In FIG. 4, the revolution of the planetary gear 56 is transferred to the common gear 85 via the odd number of gears 82*a*, 82*b*, and 82*c* of the first revolution transferring unit 82. In FIG. 5, the revolution of the planetary gear 56 is transferred to the common gear 85 via the even number of gears 84*a* and 84*b* of the second revolution transferring unit 84. Therefore, even when the revolving directions of the planetary gear 56 in FIG. 4 and FIG. 5 are opposite, the revolving direction of the common gear 85 is the same. As a result, the revolution control mechanism 83 revolves the paper discharge roller 88 in the third revolving direction 88*c* with the rotation of the motor 52 regardless of the reversing of the revolving direction of the motor 52.

Figure 9:
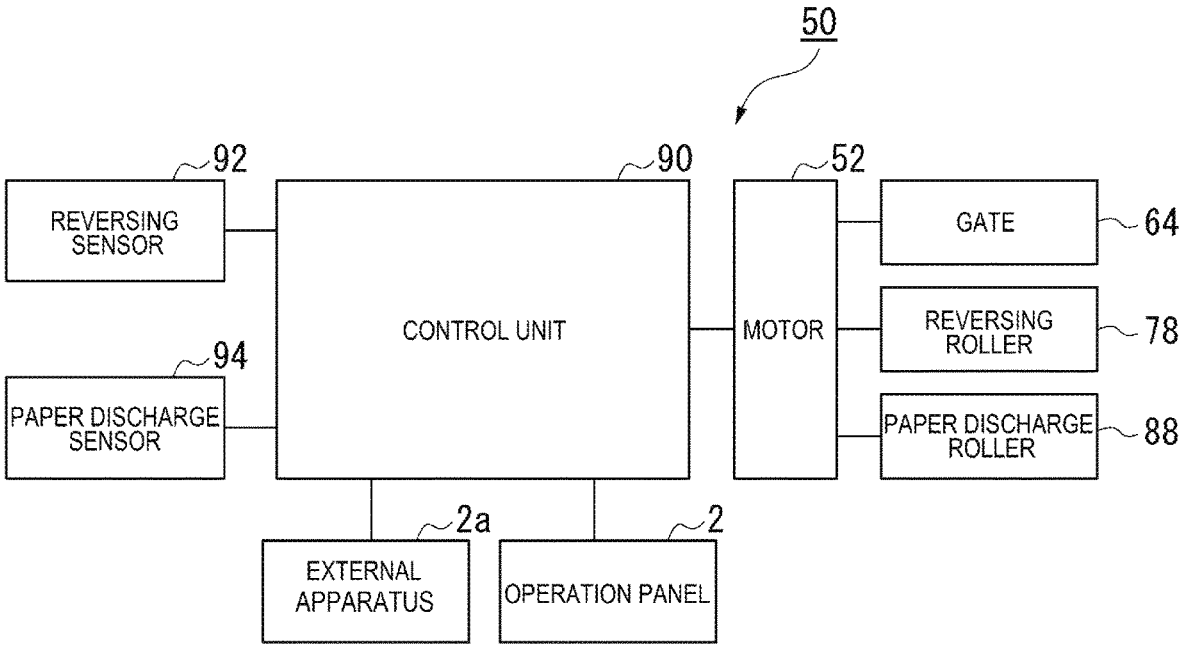
FIG. 9 is a block diagram of a sheet conveying apparatus.

FIG. 9 is a block diagram of the sheet conveying apparatus 50.

The control unit 90 is a microcomputer including a processor, such as a CPU or a GPU. The functional unit of the control unit 90 is implemented as a processor, such as a CPU, executing a program. Some or all of the functional units of the control unit 90 may be implemented with hardware, such as a LSI (Large Scale Integration), an ASIC (Application Specific Integrated Circuit), and a FPGA (Field-Programmable Gate Array), or may be implemented with a combination of software and hardware.

The control unit 90 receives an instruction for duplex printing from the operation panel 2 or an external apparatus 2*a*. The control unit 90 controls the revolving direction and revolving timing of the motor 52, thereby driving the gate 64, the reversing roller 78, and the paper discharge roller 88. As a result, the sheet conveying apparatus 50 conveys the sheet S for duplex printing.

In addition to the above-described configuration, the sheet conveying apparatus 50 also includes a reverse sensor 92 and a discharge sensor 94.

As shown in FIG. 2, the reverse sensor 92 is disposed on the downstream side of the reversing roller 78 in the first conveying direction D1. For example, the reverse sensor 92 is an optical sensor. The reverse sensor 92 detects the flow of the sheet S. The reverse sensor 92 detects passage of the leading end of the sheet S conveyed in the first conveying direction D1. The reverse sensor 92 transmits a detection signal to the control unit 90 shown in FIG. 9.

The control unit 90 controls the driving of the motor 52 based on a result of detection by the reversing sensor 92. The control unit 90 determines that the sheet S arrived at the switch-back position SB when a predetermined time is elapsed since a detection signal is received from the reversing sensor 92. At this time, the control unit 90 revolves the motor 52 in the second direction 52*b* as shown in FIG. 5. Along with this, the gate 64 rotates to the second position P2 and the reversing roller 78 revolves in second revolving direction 78*b*. As a result, as shown in FIG. 3, the single-sided printed sheet S is conveyed in the second conveying direction D2. Also, the gate 64 is located at the second position P2, and the paper discharge roller 88 revolves in third revolving direction 88*c*. As a result, the duplex printed sheet S is conveyed in the third conveying direction D3.

As shown in FIG. 3, the discharge sensor 94 is disposed on the downstream side of the fixing unit 36 in the third conveying direction D3 and is disposed between the fixing unit 36 and the gate 64. For example, the discharge sensor 94 is an optical sensor. The discharge sensor 94 detects the flow of the sheet S. The discharge sensor 94 detects passage of the trailing end of the sheet S conveyed in the third conveying direction D3. The discharge sensor 94 transmits a detection signal to the control unit 90 shown in FIG. 9.

The control unit 90 controls the driving of the motor 52 based on a result of detection by the discharge sensor 94. When a detection signal of the discharge sensor 94 is received, the control unit 90 revolves the motor 52 in the first direction 52*a* as shown in FIG. 4. Along with this, the gate 64 rotates to the first position P1 and the reversing roller 78 revolves in first revolving direction 78*a*. As a result, as shown in FIG. 2, the single-sided printed sheet S is conveyed in the first conveying direction D1.

A sheet conveying method for duplex printing using the sheet conveying apparatus 50 will be described.

Figure 10:
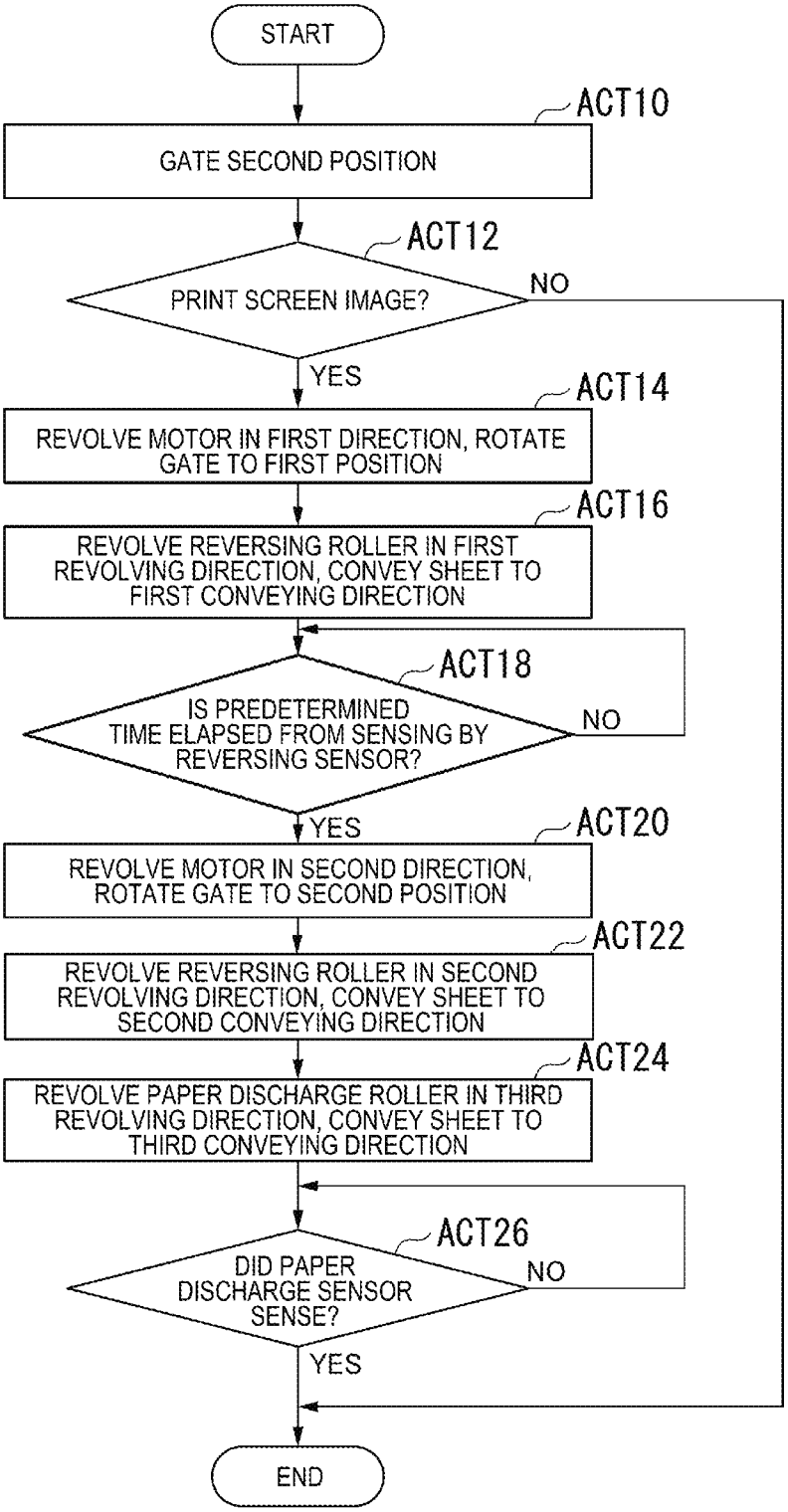
FIG. 10 is a flowchart of a sheet conveying method for duplex printing.

FIG. 10 is a flowchart of a sheet conveying method for duplex printing. The control unit 90 repeats the process of the sheet conveying method shown in FIG. 10.

The sheet conveying apparatus 50 discharges the printed sheet S from the paper discharge roller 88 to the paper discharge tray 38 in both duplex printing and single-sided printing. When the preceding sheet S is discharged from paper discharge roller 88, the gate 64 is located at the second position P2. Here, the sheet conveying method is started with the gate 64 located at the second position P2 (ACT 10).

The control unit 90 determines whether an instruction for duplex printing is received (ACT 12). When a result of the determination in ACT12 is No, the overall process is terminated without performing the sheet conveying method for duplex printing.

When a result of the determination in ACT12 is Yes, the control unit 90 revolves the motor 52 in the first direction 52*a* (ACT 14) as shown in FIG. 4. As a result, the gate 64 rotates from the second position P2 to the first position P1. The torque restricting member 62 holds the gate 64 at the first position P1 while a torque of the predetermined value is being applied to the gate 64. Therefore, the control unit 90 starts conveying the sheet S without waiting for the attenuation of the bounce of gate 64.

When the motor 52 revolves in the first direction 52*a*, the reversing roller 78 revolves in the first revolving direction 78*a* (ACT 16). As a result, as shown in FIG. 2, the single-sided printed sheet S is conveyed in the first conveying direction D1 from the fixing unit 36 to the switch-back position SB.

The control unit 90 determines whether a predetermined time is elapsed since the reverse sensor 92 detected passage of the leading edge of the sheet S (ACT 18).

When a result of the determination in ACT18 is Yes, the control unit 90 revolves the motor 52 in the second direction 52*b* (ACT 20) as shown in FIG. 5. As a result, the gate 64 rotates from the first position P1 to the second position P2. The torque restricting member 62 holds the gate 64 at the second position P2 while a torque of a predetermined value is being applied to the gate 64. Therefore, the control unit 90 starts conveying the sheet S without waiting for the attenuation of the bounce of gate 64.

When the motor 52 revolves in the second direction 52*b*, the reversing roller 78 revolves in the second revolving direction 78*b* (ACT 22). As a result, as shown in FIG. 3, the single-sided printed sheet S is conveyed from the switch-back position SB in the second conveying direction D2 toward the paper re-feeding path 44. By the action of the coupling 73, after the gate 64 is rotated toward the second position P2, the reversing roller 78 starts to revolve. Therefore, the sheet S is conveyed smoothly in the second conveying direction D2.

As shown in FIG. 5, when the motor 52 revolves in the second direction 52*b*, the paper discharge roller 88 revolves in the third revolving direction 88*c* (ACT 24). As a result, as shown in FIG. 3, the duplex printed sheet S is conveyed in the third conveying direction D3 from the fixing unit 36 toward the discharge tray 38.

The control unit 90 determines whether the discharge sensor 94 detected passage of the trailing end of the sheet S (ACT 26). When a result of the determination in ACT26 is "Yes", the process of the sheet conveying method shown in FIG. 10 is terminated first, and the process of the sheet conveying method is executed again. At this point, the gate 64 is located at the second position P2 (ACT 10). The control unit 90 subsequently determines whether an instruction for duplex printing is received (ACT 12). When a result of the determination in ACT12 is Yes, the control unit 90 revolves the motor 52 in the first direction 52*a* (ACT 14) as shown in FIG. 4. As a result, the gate 64 rotates from second position P2 to the first position P1.

At a time point where the discharge sensor 94 detects the passage of the trailing end of the sheet S, the duplex printed sheet S is not yet discharged from the paper discharge roller 88 to the discharge tray 38. At this point, the control unit 90 revolves the motor 52 in the first direction 52*a* and rotates the gate 64 to the first position P1. As a result, conveyance of a subsequent single-side printed sheet S in the first conveying direction D1 is started quickly. Even when the control unit 90 revolves the motor 52 in the first direction 52*a*, the paper discharge roller 88 revolves in the third revolving direction 88*c*. As a result, the duplex printed sheet S is continuously conveyed in the third conveying direction D3 and discharged from the paper discharge roller 88 to the discharge tray 38.

As described in detail above, the sheet conveying apparatus 50 according to at least one embodiment includes the paper re-feeding path 44, the gate 64, the reversing roller 78, the paper discharge roller 88, the motor 52, and the revolution control mechanism 83. The paper re-feeding path 44 reverses the front and back of the sheet S, which is conveyed from the printing unit 20 and switched back at the switch-back position SB, and re-feeds the sheet S to the printing unit 20. The gate 64 can switch the position between the first position P1 and the second position P2. The first position P1 is a position for guiding the sheet S in first conveying direction D1 from printing unit 20 toward the switch-back position SB. The second position P2 is a position for guiding the sheet S in the second conveying direction D2 from the switch-back position SB toward the paper re-feeding path 44 and guiding the sheet S in the third conveying direction D3 from the printing unit 20 toward the discharge tray 38. The reversing roller 78 can switch the revolving direction thereof between the first revolving direction 78*a* and the second revolving direction 78*b*. The first revolving direction 78*a* is a revolving direction for conveying the sheet S in the first conveying direction D1. The second revolving direction 78*b* is a revolving direction for conveying the sheet S in the second conveying direction D2. The paper discharge roller 88 revolves in a third revolving direction 88*c* for conveying the sheet S in third conveying direction D3. By reversing the revolving direction thereof, the motor 52 reverses the revolving direction of the reversing roller 78 and switches the position of gate 64. The revolution control mechanism 83 revolves the paper discharge roller 88 in the third revolving direction 88*c* with the rotation of the motor 52 regardless of the reversing of the revolving direction of the motor 52.

Since the motor 52 switches the position of the gate 64, the time for switching the position of the gate 64 is shortened. As a result, conveyance of the sheet S is started quickly, thereby shortening the conveying time of the sheet S. Furthermore, the position of the gate 64 is switched by using the motor 52 which revolve-drives the reversing roller 78. As a result, increase of cost for the sheet conveying apparatus is suppressed. Furthermore, the revolution control mechanism 83 revolves the paper discharge roller 88 in the third revolving direction 88*c* with the revolution of the motor 52 regardless of the reversing of the revolving direction of the motor 52. Therefore, even when the position of the gate 64 is switched from the second position P2 to the first position P1 by the motor 52, the paper discharge roller 88 revolves in the third revolving direction 88*c*. As a result, the sheet S is continuously conveyed in third conveying direction D3, and the sheet S is discharged from paper discharge roller 88. Accordingly, by advancing the timing for switching the position of the gate 64, conveyance of a subsequent sheet S in the first conveying direction D1 is quickly started. Therefore, the conveying time of the sheet S is shortened. Furthermore, the paper discharge roller 88 is revolved by using the motor 52 which revolve-drives the reversing roller 78. As a result, increase of cost for the sheet conveying apparatus 50 is suppressed.

The revolution control mechanism 83 includes the planetary gear 56, the common gear 85, the first revolution transferring unit 82, and the second revolution transferring unit 84. The planetary gear 56 engages with the sun gear 54 that revolves in conjunction with the motor 52. The planetary gear 56 can revolve around the sun gear 54 as the sun gear 54 revolves. The planetary gear 56 can revolve according to the revolution of the sun gear 54. The common gear 85 revolves the paper discharge roller 88. The first revolution transferring unit 82 can engage with the planetary gear 56 at a third position P3 on the revolution trajectory of the planetary gear 56. The first revolution transferring unit 82 can engage with the common gear 85 and revolve the common gear 85 in the fourth revolving direction 85*c* with the revolution of the planetary gear 56. The second revolution transferring unit 84 can engage with the planetary gear 56 at the fourth position P4 on the revolution trajectory of the planetary gear 56. The second revolution transferring unit 84 can engage with the common gear 85 and revolve the common gear 85 in the fourth revolving direction 85*c* with the revolution of the planetary gear 56.

According to this arrangement, when the motor 52 revolves in the first direction 52*a*, the planetary gear 56 revolves to the third position P3, and the planetary gear 56 revolves at the third position P3 in the third direction 56*a*. The first revolution transferring unit 82 revolves the common gear 85 in the fourth revolving direction 85*c* with the revolution of the planetary gear 56 in the third direction 56*a*. When the motor 52 revolves in the second direction 52*b*, the planetary gear 56 revolves to the fourth position P4 and revolves at the fourth position P4 in the fourth direction 56*b*. The second revolution transferring unit 84 revolves the common gear 85 in the fourth revolving direction 85*c* with the revolution of the planetary gear 56 in the fourth direction 56*b*. As described above, regardless of the revolving direction of the motor 52, the common gear 85 revolves in the fourth revolving direction 85*c*, and thus the paper discharge roller 88 revolves in the third revolving direction 88*c*. Furthermore, the revolution control mechanism 83 is formed at a low cost.

One of the first revolution transferring unit 82 and the second revolution transferring unit 84 includes an odd number of gears engaged with one another in series. The other one of the first revolution transferring unit 82 and the second revolution transferring unit 84 includes an even number of gears engaged with each other in series.

According to this arrangement, the common gear 85 revolves in the fourth revolving direction 85*c*, regardless of the reversing of the revolving direction of the motor 52, and thus the paper discharge roller 88 revolves in the third revolving direction 88*c*. Furthermore, the revolution control mechanism 83 is formed at a low cost.

The sheet conveying apparatus 50 includes a sheet discharge sensor 94 and the control unit 90. The discharge sensor 94 is disposed on the downstream side of the printing unit 20 in the third conveying direction D3 and detects the flow of the sheet S. The control unit 90 switches the position of the gate 64 from the second position P2 to the first position P1 based on a result of detection by the discharge sensor 94.

According to this arrangement, the position of the gate 64 is switched from the second position P2 to the first position P1 while a preceding sheet S is being discharged in the third conveying direction D3. As a result, the conveyance of a subsequent sheet S in the first conveying direction D1 is started quickly. Therefore, the conveying time of the sheet S is shortened.

The gate 64 rotates around a rotation shaft.

According to this arrangement, a mechanism for switching the position of the gate 64 with the motor 52 is formed at low cost.

The sheet conveying apparatus 50 includes the first stopper 68 and the second stopper 69. The first stopper 68 stops the rotation of gate 64 at the first position P1. The second stopper 69 stops the rotation of gate 64 at the second position P2.

According to this arrangement, a mechanism for switching the position of the gate 64 with the motor 52 is formed at low cost.

The sheet conveying apparatus 50 includes the torque restricting member 62 on the torque transferring path between the gate 64 and the motor 52.

The torque restricting member 62 stops the gate 64 at the first position P1 or the second position P2 with a torque of a predetermined value applied onto the gate 64. Therefore, the bounce of gate 64 to first stopper 68 or second stopper 69 is prevented. Along with this, the conveyance of the sheet S is started quickly without waiting for the attenuation of the bounce of the gate 64. Therefore, the conveying time of the sheet S is shortened.

The sheet conveying apparatus 50 includes a delaying member. The delaying member delays the start of reversing of a revolving direction of the reversing roller 78 to be later than the start of reversing of the revolving direction of the motor 52. The delaying member is the coupling 73.

When the motor 52 revolves in the second direction 52*b*, the gate 64 rotates from the first position P1 to the second position P2. The delaying member delays the start of reversing of the reversing roller 78 to the second revolving direction 78*b* to be later than the start of reversing of the motor 52 to the second direction 52*b*. Therefore, after the gate 64 rotates toward the second position P2, the conveyance of the sheet S in the second conveying direction D2 by the reversing roller 78 is started. Therefore, conveyance failure of the sheet S is prevented. Due to the coupling, the delaying member is formed at low cost. The delaying member may be an electromagnetic clutch.

The sheet conveying apparatus 50 includes the reverse sensor 92 and the control unit 90. The reversing sensor 92 is disposed on the downstream side of the reversing roller 78 in the first conveying direction D1 and detects the flow of the sheet S. The control unit 90 switches the position of the gate 64 from the first position P1 to the second position P2 based on a result of detection by the reversing sensor 92.

According to this configuration, the position of the gate 64 is switched from first position P1 to second position P2 at the timing where the sheet S is placed in the switch-back position SB.

According to at least one of the embodiments described above, the motor 52 reverses the revolving direction thereof, thereby reversing the revolving direction of the reversing roller 78 and switching the position of the gate 64. Regardless of the reversing of the revolving direction of the motor 52, the revolution control mechanism 83 revolves the paper discharge roller 88 in the third revolving direction 88*c* with the revolution of the motor 52. Therefore, the conveying time of a sheet is shortened.

While certain embodiments have been described these embodiments have been presented by way of example only, and are not intended to limit the scope of the inventions. Indeed, the novel embodiments described herein may be embodied in a variety of other forms. Furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet conveying apparatus comprising:

a paper re-feeding path for reversing the front and back of a sheet conveyed from a printer and switched back at a switch-back position and re-feeding to the printer;

a switch configured to be switched between:

a first position, for guiding the sheet in a first conveying direction from the printer toward the switch-back position, and a second position, for guiding the sheet in a second conveying direction from the switch-back position toward the paper re-feeding path and guiding the sheet in a third conveying direction from the printer toward a discharge tray;

a reversing roller configured to reverse a revolving direction of the reversing roller between a first revolving direction, for conveying the sheet in the first conveying direction, and a second revolving direction, for conveying the sheet in the second conveying direction;

a paper discharge roller configured to revolve in a third revolving direction for conveying the sheet in a third conveying direction;

a motor configured to reverse the revolving direction of the reversing roller and switch the position of the switch by reversing the revolving direction of the motor; and a revolution controller configured to revolve the paper discharge roller in the third revolving direction with the revolution of the motor, regardless of the reversing of the revolving direction of the motor.

2. The apparatus of claim 1, wherein the revolution controller includes:

a planetary gear configured to:

engage with a sun gear that revolves in conjunction with the motor, revolve around the sun gear as the sun gear revolves, and revolve according to the revolution of the sun gear;

a common gear configured to cause the paper discharge roller to revolve;

a first revolution transferring unit configured to engage with the planetary gear at a third position on the revolution trajectory of the planetary gear and configured to engage with the common gear and causing the common gear to revolve in a fourth revolving direction with the revolution of the planetary gear; and a second revolution transferring unit configured to engage with the planetary gear at a fourth position on the revolution trajectory of the planetary gear and configured to engage with the common gear and cause the common gear to revolve in the fourth revolving direction with the revolution of the planetary gear.

3. The apparatus of claim 2, wherein one of the first revolution transferring unit and the second revolution transferring unit includes an odd number of gears engaged with one another in series, and the other one of the first revolution transferring unit and the second revolution transferring unit includes an even number of gears engaged with each other in series.

4. The apparatus of claim 1, further comprising:

a paper discharge sensor disposed on a downstream side of the printer in the third conveying direction and configured to detect the flow of the sheet; and a switch controller configured to switch the position of the switch from the second position to the first position based on a result of detection by the discharge sensor.

5. The apparatus of claim 1, wherein the switch is a gate configured to rotate around a rotation shaft.

6. The apparatus of claim 5, further comprising:

a first stopper configured to stop rotation of the gate at the first position; and a second stopper configured to stop rotation of the gate at the second position.

7. The apparatus of claim 6, further comprising:

a torque restrictor on a torque transferring path between the gate and the motor.

8. The apparatus of claim 7, wherein the torque restrictor is one of a torque limiter or a spring clutch.

9. The apparatus of claim 7, further comprising a gate driving gear configured to drive the gate.

10. The apparatus of claim 9 wherein the torque restrictor is configured to apply a torque having a predetermined value to the gate when a torque exceeding the predetermined value is applied by the gate driving gear.

11. The apparatus of claim 1, further comprising:

a delaying member configured to delay the start of reversing of the revolving direction of the reversing roller to be later than the start of reversing of the revolving direction of the motor.

12. The apparatus of claim 11, wherein the delaying member is a coupling.

13. The apparatus of claim 12, further comprising a reversing roller driving gear arranged to drive the reversing roller, wherein the coupling is disposed between the reversing roller driving gear and the reversing roller.

14. The apparatus of claim 13, wherein the coupling includes a driving hand having a plurality of driving teeth, and a driven hand having a plurality of driven teeth arranged to engage with the driving teeth, the driving teeth arranged alternately with the driven teeth with an interval between adjacent driving teeth and driven teeth.

15. The apparatus of claim 1, further comprising:

a reversing sensor disposed on a downstream side of the reversing roller in the first conveying direction and configured to detect the flow of the sheet; and a switch controller configured to switch the position of the switch from the first position to the second position based on a result of detection by the reversing sensor.

* * * * *